United States Patent [19]

Sharp et al.

[11] Patent Number: 4,480,391

[45] Date of Patent: Nov. 6, 1984

[54] BOREHOLE SURVEY INSTRUMENT CONTROL CIRCUITRY

[75] Inventors: Harper E. Sharp; Miles A. Smither, both of Houston, Tex.

[73] Assignee: Wilson Industries, Inc., Houston, Tex.

[21] Appl. No.: 446,630

[22] Filed: Dec. 3, 1982

[51] Int. Cl.[3] ..... E21B 47/022

[52] U.S. Cl. ..... 33/314; 33/313

[58] Field of Search ..... 33/309, 310, 313, 314, 33/364, 366

[56] References Cited

U.S. PATENT DOCUMENTS

| | | | |
|---|---|---|---|
| 2,093,128 | 9/1937 | Hewitt, Jr. et al. | 33/314 |
| 2,116,350 | 5/1938 | Hewitt, Jr. | 33/314 |
| 2,120,670 | 6/1938 | Hyer | 33/313 |
| 2,195,224 | 3/1940 | Opocensky | 33/314 |
| 2,644,242 | 7/1953 | Hewitt, Jr. | 33/314 |
| 2,756,511 | 7/1956 | Young | 33/314 |
| 4,393,598 | 7/1983 | Powell et al. | 33/314 |

*Primary Examiner*—Richard R. Stearns
*Attorney, Agent, or Firm*—Hubbard, Thurman, Turner & Tucker

[57] ABSTRACT

A borehole survey instrument and control circuitry are described. The borehole survey instrument includes indicators for measuring angle of deviation from the vertical and angle of deviation from magnetic north and a photographic recording means for recording the output of the indicators at selected times. A lighting system is utilized in conjunction with the photographic recording means to expose photographic film and a novel time control circuit is utilized in conjunction with the lighting system to alter the length of time of illumination in accordance with the operativeness of individual bulbs within the lighting system. In this manner, the failure of one or more bulbs within the lighting system will not substantially affect the amount of illumination to which the film in the photographic recording means is exposed.

9 Claims, 2 Drawing Figures

BOREHOLE SURVEY INSTRUMENT CONTROL CIRCUITRY

Figure 1:
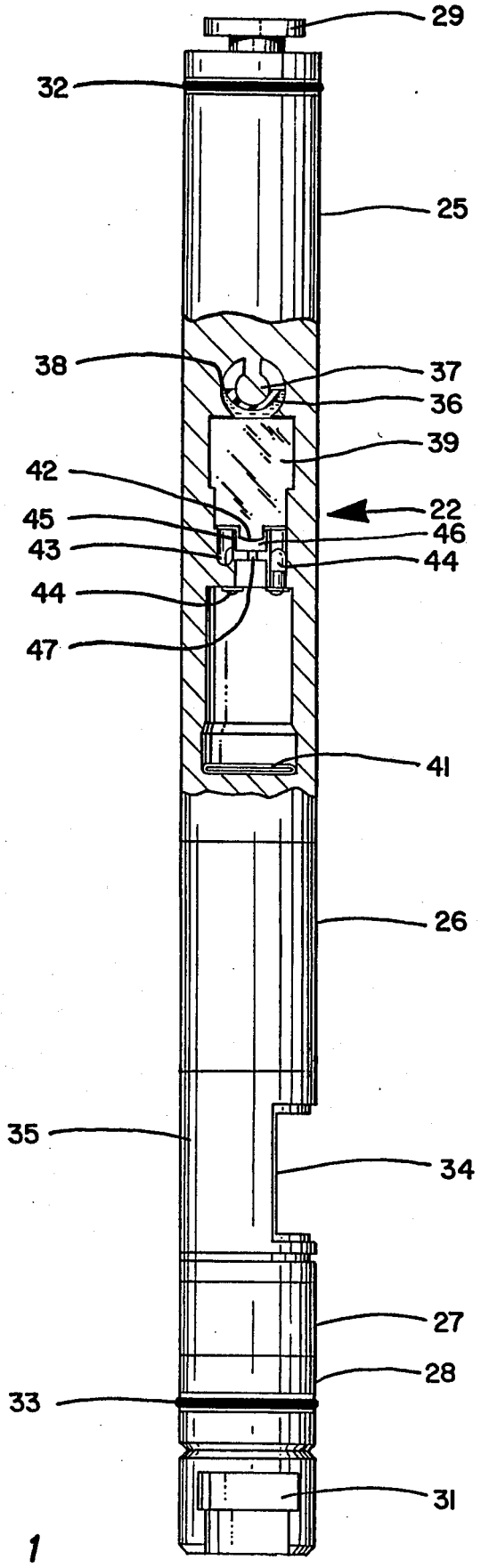

This invention relates to borehole survey instruments in general and more particularly to photographic type survey instruments and methods for controlling the photographic lighting circuitry thereof.

Borehole survey instruments are utilized to determine the location of a wellbore relative to a vertical line projected through the well site. This is particularly important in the petroleum industry where deep boreholes can diverge dramatically from a vertical projection of the point of entry into the earth. Further, there are many instances where it is desired to cause the borehole to purposefully deviate at a relatively high angle in order to reach deep strata displaced horizontally from the well site. Prime examples of this need are in offshore production where a large number of highly divergent wells are typically drilled from a single platform in order to produce fluids from a large area utilizing a single drilling and production platform. Directional drilling capabilities have been increased to the point where even a deep wellbore can be drilled along a desired path to arrive at a preselected subterranean location. Such techniques typically employ a hydraulic mud motor mounted on the end of specialized drill collars, i.e. bent subs, on the drill string which is held stationary as the bit is rotated by the motor.

However, in order to effectively accomplish such directional drilling, it is necessary to ascertain the current location of the bit, i.e., deviation and direction of deviation at that depth, and also to ascertain the current attitude, i.e., the inclination to the vertical and the azimuthal direction of the inclination of the borehole, and more specifically of the drill string and thus the bit at or near the bottom of the borehole. The location of the borehole at any given depth can be determined generally by knowing the angle and inclination of the borehole at a series of depth stations and computing the ultimate location utilizing dead reckoning computation.

For many years, the most common instruments for measuring the angle and direction of deviation of a borehole have utilized a photographic system to record the position of an indicator which is responsive to both magnetic north and gravity. A photographic film is fixed within the housing of the instrument and then exposed through a lens system to record the relative position of a reticle fixed to the housing of the instrument to certain reference indicia on a compass member, thus recording the degree of inclination and azimuthal orientation of the instrument housing, and therefore of the drill string and hence the borehole at that depth. The single photographic record is then retrieved either by wireline, or when the drill string is removed to replace the bit, the film developed and the attitude of the borehole determined.

Prior art devices have required extremely skilled technicians to run the tools and interpret the data. The technician must operate in extremely unfriendly environments of heat, cold, noise, filth and hazard to his person while performing tests which require significant attention to detail. It is of utmost importance for the operator to perform his task in an efficient and reliable manner so as to minimize down time of the very expensive drilling rigs and crew, and prevent, if at all possible, a trip into the wellbore which collects no data, thus requiring another run. A primary failure mode of such survey instruments is a failure of the bulb or bulbs which are utilized to expose the photographic film. In those cases in which a plurality of bulbs are utilized, even the failure of a single bulb can substantially degrade the exposure of the film to the point where the data is unreadable.

It is therefore, an object of the present invention to provide an improved photographic type borehole survey instrument which has enhanced reliability over known survey instruments.

More specifically, an important object of the present invention is the provision of a photographic type borehole survey instrument which includes an improved photographic lighting control circuit.

These and other objects are accomplished in accordance with the present invention by providing a time control circuit for lighting systems used in conjunction with photographic type borehole survey instruments in which the length of time of illumination of the bulbs is controlled in accordance with the number of operating bulbs in order that the total amount of light to which the film is exposed is approximately the same with one or more bulbs illuminated.

Figure 2:
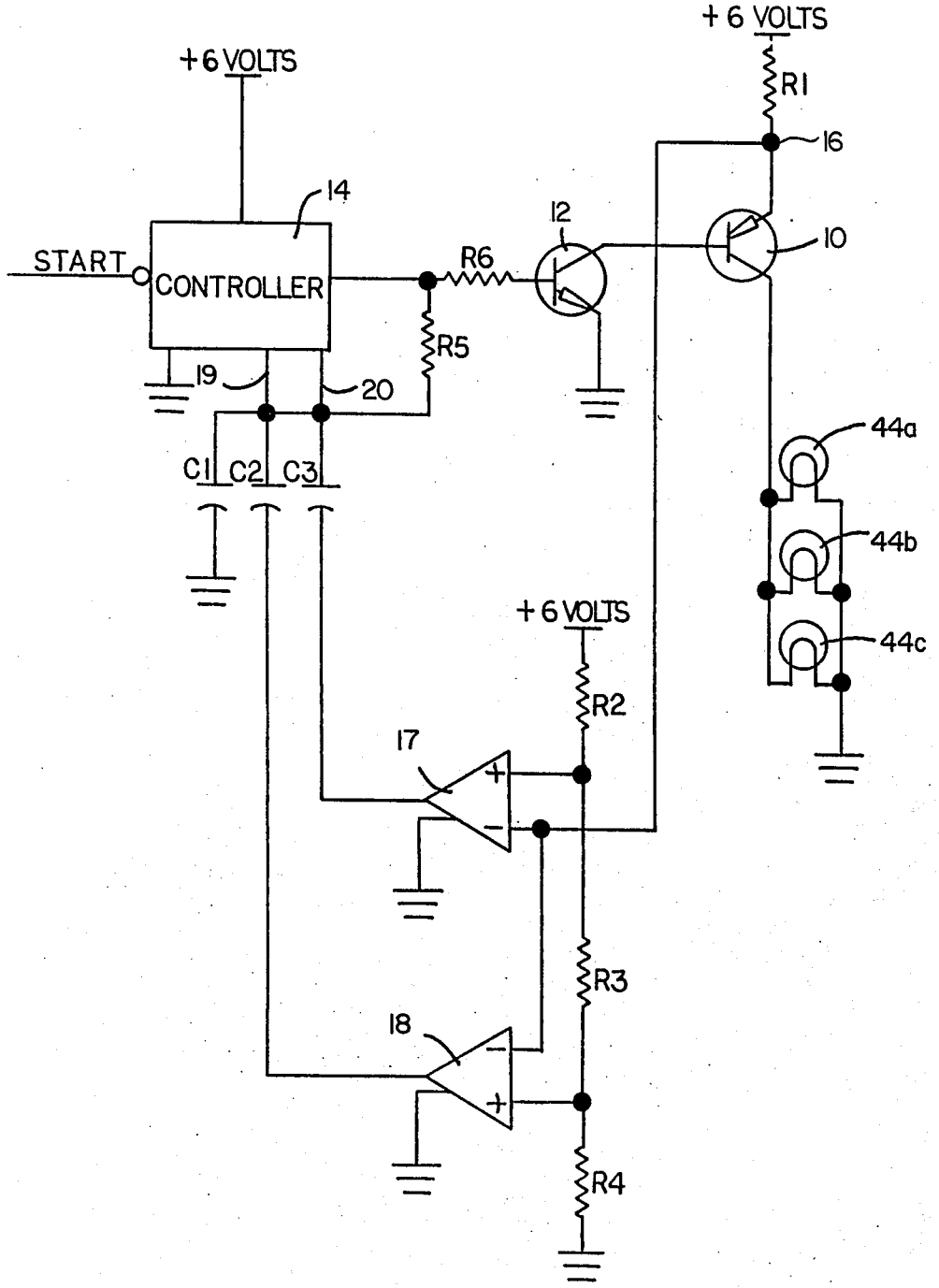

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

FIG. 1 is a schematic view, partially broken away to illustrate the layout of the azimuth and inclination measurement and photographic recording system of the survey instrument of the present invention; and FIG. 2 is an electrical schematic diagram of the lighting control circuitry of the novel photographic type borehole survey instrument of the present invention.

Referring to FIG. 1, the survey instrument indicated generally at 22 includes a tubular housing made up of a plurality of housing sections 25, 26, 27 and 28. At the upper and lower ends of the body, there are provided connector means 29 and 31 for connecting the body to additional tools having complementary connector means so that multiple survey instruments may be run and the instruments may be connected to shock absorber means (not shown) for protecting the instrument.

For further protecting the instrument, there are provided adjacent the upper and lower ends of the instrument annular resilient members 32 and 33 which center the instrument within the pressure barrel and protect it against lateral shock.

The housing has a window 34 therein, and a rotatable cover or shield 35 which is shown in the open position and which may be rotated about 180° to a position covering the window 34. The window 34 has a number of electrical connections therein which may be utilized to program the instrument.

An azimuth and vertical deviation angle indicating unit includes a hemispherical indicating member 36 having indicia on the lower surface thereof indicating both attitude and azimuth. Indicating member 36 is floated in a liquid 38, and held in a centered position by a post 37. The lower end of the post 37 is a spherical ball against which the indicating member 36 bears. Indicating member 36 is designed to use the surface tension of the liquid 38, which will cause indicating member 36 to remain level with the surface and thus be constantly indicating of the earth's gravity and thus vertical, and is magnetized like a compass card to be magnetically driven to a predetermined orientation with respect to magnetic north. Thus, as the tool is tilted from the vertical, the indicating member 36 will move about the end of post 37 so that its upper surface remains horizontal and, of course, parallel to the level of liquid 38, and will rotate about the end of post 37 to maintain at all times its position relative to the magnetic field of the earth. The housing of the tool as well as the pressure barrel and the portion of the drill pipe in which the tool is loaded are fabricated from non-magnetic material to the extent necessary to prevent their interfering with proper response of the indicating means to the earth's magnetic field.

A cylindrical body 39 forms the lower wall of the chamber which contains the floatation liquid 38. Body 39 is formed of a glass material having an index of refraction which is substantially the same as the index of refraction of the liquid 38. For instance, body 39 may be ground from crown glass and the liquid may be perchloroethylene with the glass and liquid having substantially the same index of refraction. If the glass and liquid are of the same index of refraction, there is no reflection or bending of light rays as they pass from the indicia on the indicating member 36 through the interface between the glass and liquid. Small differences in the refractive index result in some bending of the light rays which is acceptable. Where the indexes of refraction are different, they should be selected to provide the most parallel rays through body 39 traveling away from indicating member 36, i.e., the liquid should have a lower index of refraction than the solid medium. In other words, the relative index of the two media is preferably zero and if the relative idex is not zero, the relative index between the crown glass and liquid is preferably such that as the light is passed back into the crown glass, it is bent toward the normal.

While the spacing of the indicating member 36 from body 39 is not critical, best results will be obtained if the spacing is less than one hundred thousandths (0.100) of an inch, and is preferably on the order of thirty thousandths (0.030) of an inch, for purposes which will hereafter be set forth in greater detail.

A source of light for momentarily illuminating the indicia on indicating member 36 is provided by three light bulbs 44, only two of which are illustrated in this drawing, which are disposed symmetrically about an annular, upwardly facing reflective groove 43 having a curved bottom. The curved bottom of groove 43 is preferably finished with a high polish so that it will reflect light upwardly through the body 39. The novel control circuitry utilized to determine the operating time for bulbs 44 is illustrated in FIG. 2 herein.

Cylindrical body 39 is preferably constructed to function as a light pipe to efficiently direct diffused or distributed light to illuminate the indicia on indicating member 36. Thus, body 39 preferably has a finish around its cylindrical surface to direct light along the longitudinal axis of the cylindrical body.

A lens 42 is provided to focus the image of the illuminated indicating member 36 onto film 41. To reduce as much as possible problems incident to reflection and bending of light rays due to interfaces between media having different indexes of refraction, it is preferred that the lens 42 be formed on the lower end of the solid body 39, and to also eliminate the need for separate lens mounting, the space for separate lens, and reduce the cost of materials. The lens portion 42 of body 39 is provided on a centrally located downwardly projecting teat on body 39 which projects into the bore 46 thus shielding the lens from direct rays of light from the bulbs 44 and reflective groove 43. An aperture 47 is formed at the lower end of the bore 46 and functions in the usual manner to circumscribe the image projected onto the film 41.

Referring now to FIG. 2, there is depicted a schematic diagram of the lighting control system of the photographic type survey instrument of the present invention. Survey instruments such as those depicted in FIG. 1 typically utilize an on board source of electric power, such as a six volt battery, to provide electric power to the lighting circuit which exposes the film. Thus, this six volt battery source may also be utilized to supply electric power to the lighting control system depicted in FIG. 1.

In order to expose film 41 (See FIG. 1), a plurality of electric light bulbs **44*a*, 44*b* are typically provided. Light bulbs 44*a*, 44*b* and 44*c* are electrically coupled in parallel to the six volt power supply through the emitter-collector circuitry of transistor 10 and resistor R1. It should be appreciated by those ordinarily skilled in the art that the number of such bulbs utilized will depend upon the design of the borehole survey instrument and that the lighting control circuit of the present invention will have application so long as more than one light bulb is utilized. Transistor 10 is then utilized to supply operating electric current to bulbs 44*a*, 44*b* and 44*c* for a selected period of time sufficient to expose film 41 and record the indicia present on indicating member 36. Transistor 10 is forward biased by the operation of transistor 12 and transistor 12 in turn is forward biased by the output of timing controller 14 through resistor R6**.

Timing controller 14 may be implemented utilizing any one of the various well known solid state circuits which are available and the choice of a specific circuit is strictly a matter of design choice. Timing controller 14 is utilized to determine the length of exposure of film 41 in response to a start signal, which is typically delayed a specified period of time from the introduction of borehole survey instrument 22 into a borehole to permit the instrument to fall to the bottom of the drill string. In this manner timing controller 14 may be utilized to select the amount of time which bulbs **44*a*, 44*b* and 44*c* will remain illuminated, thus determining the proper exposure time for film 41**.

An important function of the lighting control circuitry of the present invention is the manner in which timing controller 14 may be utilized to lengthen the exposure time of film 41 in response to a malfunction by one or more of light bulbs **44*a*, 44*b* and 44*c***.

Those ordinarily skilled in the art will appreciate that the voltage present at node 16 between the emitter of transistor 10 and resistor R1 will be a function of the current through transistor 10, the resistance of resistor R1 and the equivalent resistance of light bulbs **44*a*, 44*b* and 44*c*. Thus, if any one or more of light bulbs 44*a*, 44*b* and 44*c* fail, the equivalent resistance of the remaining bulbs will increase in accordance with well known resistive network laws. An increase in the equivalent resistance of the cicrcuit comprised of the remaining light bulbs will corresponding decrease the current through transistor 10 and thereby decrease the voltage drop across resistor R1, increasing the voltage present at node 16. The voltage present at node 16 is then applied to the inputs of comparators 17 and 18** and compared to the reference voltages derived from the voltage divider comprising resistor R2, R3 and resistor R4.

In this manner, the voltage present at node 16 can be utilized to determine the number of bulbs operating in the collector circuit of transistor 10 and the incremental changes in the voltage present at node 16 can be utilized to operate the outputs of comparators 17 and 18. As can be seen, a comparator is provided for each bulb in excess of one; however, if large numbers of bulbs are utilized it is within the scope of the intent of this invention to utilize a single comparator for a group of bulbs.

Those skilled in the art will appreciate that the voltage divider comprising resistors R2, R3 and R4 will apply a different reference voltage to the positive input of comparator 17 and comparator 18 in order that each comparator can function to identify the failure of a particular number of bulbs. Preferably, resistors R1, R2, R3 and R4 are selectively chosen so that when bulbs 44*a*, 44*b* and 44*c* are all illuminated the voltage present at node 16 will be less than the voltages present at the positive inputs at comparators 17 and 18. Additionally, if a single one of bulbs 44*a*, 44*b* and 44*c* has malfunctioned, the voltage divider provided will ensure that the voltage present at node 16 is greater than the voltage present at the positive input to comparator 18, but less than the voltage present at the positive input of comparator 17. Finally, where two of the three bulbs illustrated have malfunctioned, the voltage at node 16 will be greater than the voltage at the positive input of comparator 17 and comparator 18.

The operation of timing control 14 is controlled by a timing circuit comprised of capacitors C1, C2 and C3. One of the capacitors, C1, is grounded. Capacitor C2 is coupled to the output of comparator 18 and in like manner capacitor C3 is coupled to the output of comparator 17.

The three timing capacitors are also coupled to each other and to the output of timing collector 14 through resistor R5. The capacitors are also connected to timing controller 14 through line 19 to signal timing controller 14 that the capacitors have been charged to a selected threshold voltage and through line 20 to a disable circuit to prevent triggering of timing controller 14 by a false signal.

When the START control is activated, timing controller 14 is switched, forward biasing transistors 10 and 12 and bulbs 44*a*, 44*b* and 44*c* are all illuminated. Capacitor C1 is then gradually charged through resistor R5 to a selected threshold that will trigger timing controller 14 to switch. In this manner the amount of time that bulbs 44*a*, 44*b* and 44*c* will be illuminated can be accurately selected by selecting the RC time constant of capacitor C1 and resistor R5. If comparator 18 is coupled to a voltage at its negative input which is greater than the reference voltage at the positive input, (one bulb has failed) comparator 18 will ground its associated capacitor C2, thus including capacitor C2 in the timing circuit. If the negative input voltage is greater than the reference voltage at both comparators (two bulbs have failed), then both capacitors C2 and C3 will be grounded and included in the timing circuitry. Thus, the charging time for the capacitors will be increased if one of the other two capacitors are grounded. The charging time will be further increased if all of the capacitors are grounded. Thus the time for the capacitors to reach the selected threshold voltage will be dependent upon the number of bulbs illuminated. When the entire timing circuit reaches the threshold voltage, timing controller 14 will switch and transistors 10 and 12 will cease conduction, shutting off bulbs 44*a*, 44*b* and 44*c*.

Timing controller 14 may be implemented utilizing any desired device which can couple the six volt source to an output upon receipt of a signal and which thereafter will disconnect the six volt source from the output upon a timing circuit reaching a selected threshold voltage. In one embodiment, timing controller 14 may be implemented utilizng a monostable multivibrator.

Thus, those skilled in the art will appreciate that in the manner disclosed, the voltage drop across a plurality of light bulbs may be measured and compared to reference voltages to determine the operativeness of those bulbs, and the exposure time of a photographic type borehole survey instrument may be adjusted accordingly to compensate for lower values of illumination due to the failure of one or more bulbs. In this manner the reliability of photographic type borehole survey instruments can be greatly enhanced.

What is claimed is:

1. A wellbore survey instrument for recording selected wellbore parameters, said instrument comprising:

elongated housing means adapted to be lowered into a wellbore;

indicating means mounted to move within said housing means;

photographic recording means fixed within said housing means and axially displaced from said indicating means;

indicia disposed on said indicating means for indicating the angular position of said indicating means with respect to said housing means;

a plurality of illuminating means disposed within said housing means for illuminating said indicia for a selected period of time in response to a control signal;

means for increasing said selected period of time in response to a failure to one or more of said plurality of illuminating means; and optical means for focusing the illuminated image of said indicia on said photographic recording means.

2. The wellbore survey instrument of claim 1 wherein:

said plurality of illuminating means comprises three substantially identical incandescent bulbs electrically coupled in parallel and disposed at spaced intervals within said housing means between said photographic recording means and said indicating means.

3. The wellbore survey instrument of claim 2 wherein:

said means for increasing said selected period of time includes means for controlling the application of an electrical power source to said bulbs and means responsive to the resultant voltage drop across said bulbs for increasing said selected period of time.

4. A wellbore survey instrument for recording selected borehole parameters, said instrument comprising:

elongated housing means adapted to be lowered into a wellbore;

indicating means mounted to move within said housing means;

photographic recording means fixed within said housing means and axially displaced from said indicating means;

indicia disposed on said indicating means for indicating the angular position of said indicating means with respect to said housing means;

an electrical power source disposed within said elongated housing means;

a plurality of illuminating means disposed within said housing means for illuminating said indicia;

first switching means for coupling said electrical power source to said plurality of illuminating means;

control means for switching said first switching means for a selected period of time in response to the operativeness of said plurality of illuminating means, wherein the failure of one or more of said plurality of illuminating means will increase said selected period of time; and optical means for focusing the illuminated image of said indicia on said photographic recording means.

5. The wellbore survey instrument of claim 4 wherein:

said control means includes means for determining the operativeness of said plurality of illuminating means by comparing the voltage drop across a series resistor produced by current in said plurality of illuminating means with at least one selected reference voltage.

6. A wellbore survey instrument for recording selected borehole parameters, said instrument comprising:

elongated housing means adapted to be lowered into a wellbore;

indicating means mounted to move within said housing means;

photographic recording means fixed within said housing means and axially displaced from said indicating means;

indicia disposed on said indicating means facing said photographic recording means for indicating the angular position of said indicating means with respect to said housing means;

an electrical power source disposed within said elongated housing means;

a plurality of illuminating means disposed within said housing means for illuminating said indicia, each one of said plurality of illuminating means disposed in a position whereby it may fully illuminate said indicia;

timing control means for coupling said electrical power source to said plurality of illuminating means for a selected period of time, said timing control means having a plurality of timing circuits, each one of said plurality of timing circuits corresponding to a failure of a selected number of said plurality of illuminating means;

means for determining the operativeness of said plurality of illuminating means including a plurality of comparators for comparing the voltage drop across said plurality of illuminating means with a plurality of reference voltages, each one of said plurality of reference voltages corresponding to a failure of a selected number of said plurality of illuminating means;

means coupling the outputs of each of said plurality of comparators to a corresponding one of said plurality of timing circuits wherein said selected period of time will be increased in response to a failure of a selected number of said plurality of illuminating means; and optical means for focusing the illuminated image of said indicia on said photographic recording means.

7. The wellbore survey instrument of claim 6 wherein:

said timing control means comprises a multistable vibrator and wherein said plurality of timing circuits comprises a plurality of resistive-capacitive time constant circuits.

8. The wellbore survey instrument of claim 6 wherein:

said plurality of reference voltages is provided by a resistive voltage divider network and wherein each of said plurality of comparators is coupled to a different point on said voltage divider network.

9. The wellbore survey instrument of claim 6 wherein:

said plurality of illuminating means comprises N incandescent bulbs and wherein said timing control means includes N−1 timing circuits.

* * * * *